US009759149B2

(12) United States Patent
Martin et al.

(10) Patent No.: US 9,759,149 B2
(45) Date of Patent: Sep. 12, 2017

(54) SYSTEM AND METHOD FOR DETERMINING EXHAUST TEMPERATURE

(71) Applicant: Ford Global Technologies, LLC, Dearborn, MI (US)

(72) Inventors: Douglas Raymond Martin, Canton, MI (US); John Eric Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 14/725,564

(22) Filed: May 29, 2015

(65) Prior Publication Data

US 2016/0348600 A1 Dec. 1, 2016

(51) Int. Cl.

| | |
|---|---|
| ***F02D 41/00*** | (2006.01) |
| ***F02D 41/14*** | (2006.01) |
| ***F02D 41/24*** | (2006.01) |

(52) U.S. Cl.

CPC ..... *F02D 41/1447* (2013.01); *F02D 41/1494* (2013.01); *F02D 41/2451* (2013.01)

(58) Field of Classification Search

CPC .. F02D 41/1447; F02D 41/1446; F02D 41/30; F02D 41/0002

See application file for complete search history.

(56) References Cited

U.S. PATENT DOCUMENTS

| | | | | |
|---|---|---|---|---|
| 5,709,198 | A * | 1/1998 | Sagisaka | F02D 41/1455 123/684 |
| 5,771,688 | A * | 6/1998 | Hasegawa | F02D 41/1441 123/676 |
| 5,781,878 | A * | 7/1998 | Mizoguchi | G01N 27/4175 701/109 |
| 6,084,418 | A * | 7/2000 | Takami | F02D 41/1494 204/424 |
| 7,385,161 | B2 * | 6/2008 | Smith | G01N 27/4067 219/494 |
| 7,481,915 | B2 | 1/2009 | Davey et al. | |
| 7,523,653 | B2 * | 4/2009 | Smith | F02D 41/1446 73/114.69 |
| 7,841,769 | B2 * | 11/2010 | Ma | F02D 41/1446 374/144 |
| 8,079,351 | B2 | 12/2011 | Uhrich et al. | |
| 8,152,369 | B2 | 4/2012 | Ma et al. | |
| 8,721,854 | B2 * | 5/2014 | Aoki | G01N 27/4065 204/410 |
| 2003/0019865 | A1 * | 1/2003 | Whitney | G01N 27/4067 219/497 |
| 2003/0178016 | A1 * | 9/2003 | Nebiyeloul-Kifle | F02D 41/1494 123/676 |
| 2004/0047396 | A1 * | 3/2004 | Nomura | G01N 27/4067 374/141 |
| 2005/0252497 | A1 | 11/2005 | Yasui et al. | |

(Continued)

*Primary Examiner* — Hieu T Vo
*Assistant Examiner* — Sherman Manley
(74) *Attorney, Agent, or Firm* — Julia Voutyras; McCoy Russell LLP

(57) ABSTRACT

Methods and systems for estimating engine exhaust gas temperature and adjusting engine operation based on the engine exhaust gas temperature are disclosed. In one example, an offset value for a resistive heating element of an oxygen sensor is determined so that the resistive heating element may be a basis for providing accurate engine exhaust gas temperatures.

18 Claims, 6 Drawing Sheets

(56) References Cited

U.S. PATENT DOCUMENTS

| | | | | |
|---|---|---|---|---|
| 2005/0263397 | A1* | 12/2005 | Yasui | G05D 23/2401 204/425 |
| 2006/0117737 | A1* | 6/2006 | Ohsaki | F02D 41/0072 60/276 |
| 2007/0010932 | A1* | 1/2007 | Gotoh | F01N 11/00 701/114 |
| 2008/0128277 | A1* | 6/2008 | Fukuda | G01N 27/4175 204/401 |
| 2014/0121940 | A1 | 5/2014 | Surnilla et al. | |
| 2014/0182563 | A1* | 7/2014 | Czimmek | F02M 53/02 123/557 |
| 2014/0346041 | A1* | 11/2014 | Nishijima | G01N 27/4067 204/408 |

* cited by examiner

SYSTEM AND METHOD FOR DETERMINING EXHAUST TEMPERATURE

BACKGROUND/SUMMARY

It may be desirable to accurately determine exhaust temperatures of an engine. By determining engine exhaust temperatures, it may be possible to provide mitigating actions when exhaust temperatures may be higher than is desired. Further, determining exhaust temperatures may be useful for assessing operation of exhaust after treatment devices. One way to determine exhaust temperatures is to install thermocouples, thermistors, or other temperature sensors in an exhaust passage that directs engine combustion by-products to exhaust after treatment devices. However, the thermocouples or thermistors may degrade if they are exposed to higher exhaust temperatures. Further, performance of exhaust temperature sensors may degrade if acidic combustion byproducts accumulate on the temperature sensors. Therefore, it may be desirable to determine engine exhaust temperatures in a way that reduces the possibility of sensor degradation. Further, it may be desirable to determine exhaust temperatures in a way that is accurate and dynamic such that rapid changes in exhaust temperatures may be observable.

The inventors herein have recognized the above-mentioned disadvantages and have developed a method for an engine, comprising: estimating an offset for a resistance value of an exhaust gas sensor heater element relative to an engine operating temperature; and estimating an engine exhaust gas temperature based on the resistance value of the exhaust gas sensor and the offset.

By estimating exhaust temperature via a heater of an oxygen sensor, it may be possible to provide the technical result of measuring exhaust temperature via a sensor that is protected from exhaust system conditions. For example, an oxygen sensor heater element may be protected via a metallic shroud that covers the oxygen sensor and its heating element. Further, by determining an offset value for the oxygen sensor resistive heating element, accuracy of exhaust temperature measurements may be improved. Consequently, it may be possible to provide accurate exhaust temperatures via a sensor that has at least some protection from conditions within an engine exhaust system.

The present description may provide several advantages. Specifically, the approach may improve exhaust gas temperature estimates. Additionally, the approach may reduce exhaust gas temperature sensor degradation. Further, the approach may compensate for exhaust temperature sensor changes that occur over time, instead of one time sensor compensation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description is related to determining temperatures in an engine exhaust system. The exhaust system temperatures may be determined in an engine system such as the engine system shown in FIG. 1. Exhaust temperature measurement accuracy may be improved via determining temperature sensor resistance offset values from the electrical circuits shown in FIGS. 2-4. Graphical representations of oxygen sensor resistive heating element resistive offset values are shown In FIGS. 5-8. A method for estimating exhaust temperatures and applying exhaust temperature measurements to engine operation is shown in FIG. 9.

Figure 1:
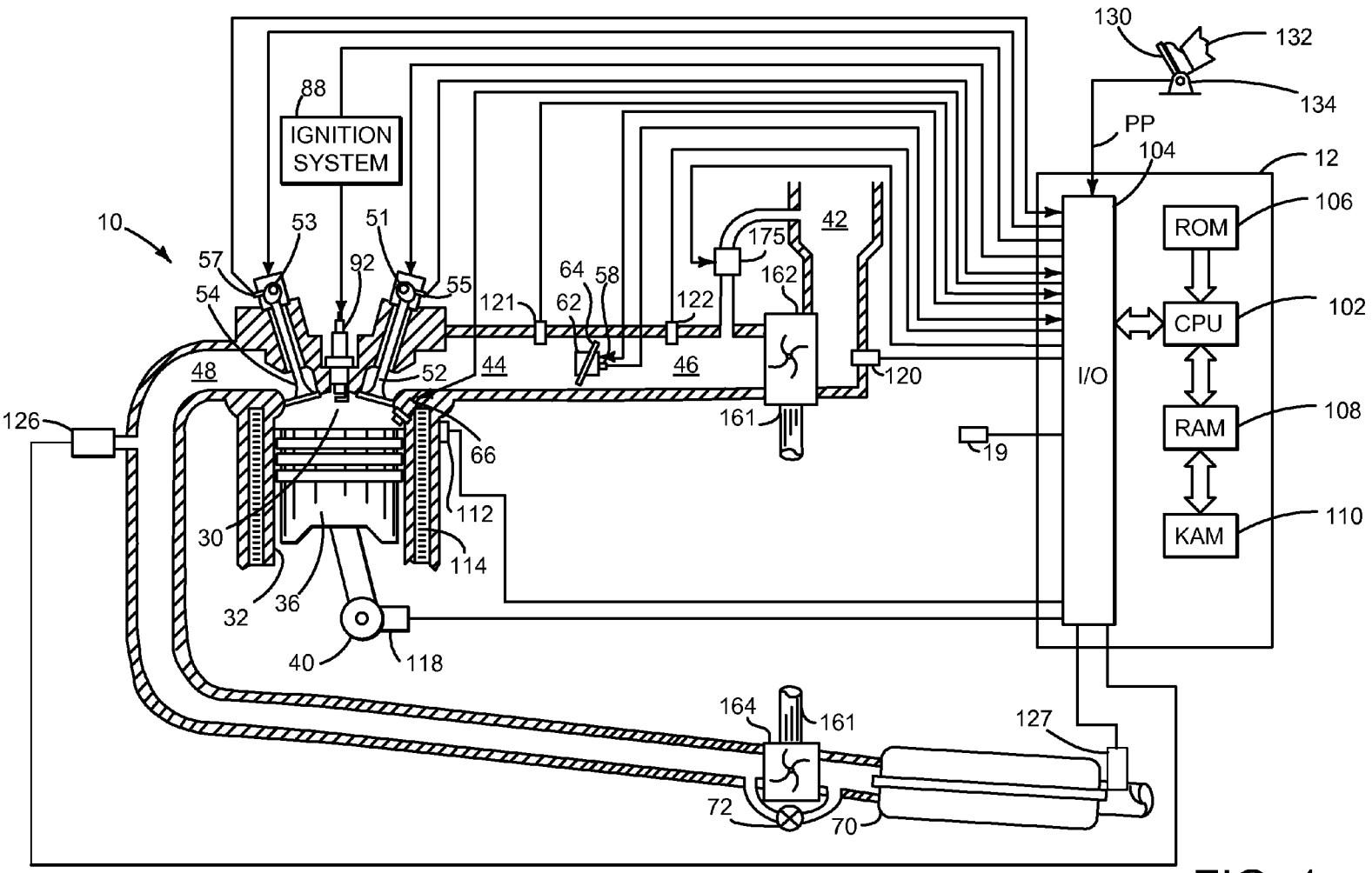
FIG. 1 shows a schematic depiction of an engine including oxygen sensors.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to a pulse width provided from controller 12. Fuel is delivered to fuel injector 66 by a fuel system including a fuel tank (not shown), fuel pump (not shown), and fuel rail (not shown). In addition, intake manifold 44 is shown communicating with optional electronic throttle 62 which adjusts a position of throttle plate 64 to control air flow from intake boost chamber 46.

Compressor 162 draws air from air intake passage 42 to supply boost chamber 46. Exhaust gases spin turbine 164 which is coupled to compressor 162 via shaft 161. Compressor bypass valve 175 may be electrically operated via a signal from controller 12. Compressor bypass valve 175 allows pressurized air to be circulated back to the compressor inlet to limit boost pressure. Similarly, waste gate actuator 72 allows exhaust gases to bypass turbine 164 so that boost pressure can be controlled under varying operating conditions.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126. A second oxygen sensor 127 is shown downstream of turbine and emissions device 70 according to a direction of exhaust gas flow.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; atmospheric pressure from barometric pressure sensor 19; a knock sensor for determining ignition of end gases (not shown); a measurement of engine manifold pressure (MAP) from pressure sensor 121 coupled to intake manifold 44; a measurement of boost pressure from pressure sensor 122 coupled to boost chamber 46; an engine position sensor from a Hall effect sensor 118 sensing crankshaft 40 position; a measurement of air mass entering the engine from sensor 120 (e.g., a hot wire air flow meter); and a measurement of throttle position from sensor 58. Engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
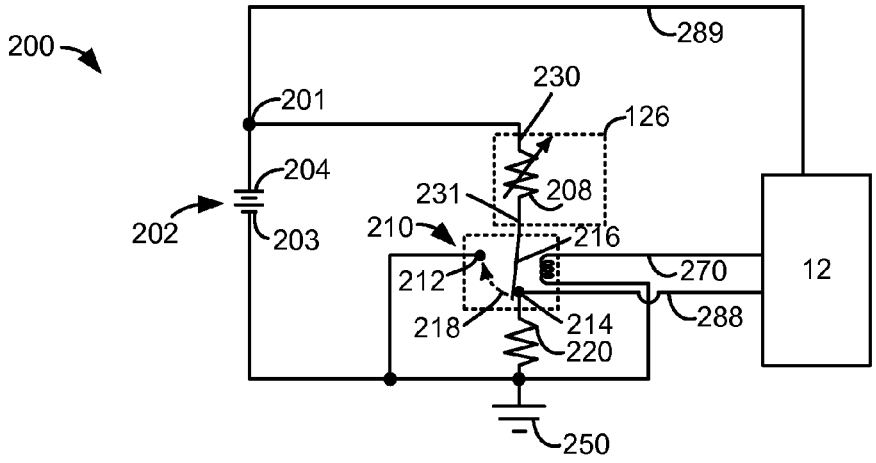
FIGS. 2-4 show example electrical circuits for estimating an oxygen sensor resistance offset.

Referring now to FIG. 2, a first example electrical circuit for estimating an oxygen sensor heater element offset resistance is shown. The circuit of FIG. 2 may be included in the system of FIG. 1 along with the method of FIG. 9 to estimate engine exhaust system temperatures.

Circuit 200 includes power source 202, which includes a positive terminal 204 and a negative terminal 203. In one example, power source 202 is a vehicle battery that stores and provides charge to vehicle charge consumers. Negative terminal 203 is shown electrically coupled to ground 250, relay terminal 212, current sense resistor 220, and a coil of relay 210. Positive terminal 204 is shown electrically coupled to a first side 230 of resistive heating element 208 of oxygen sensor 126 and controller 12. A second side 231 of resistive heating element 208 is shown electrically coupled to terminal 216 which operates as a movable wiper between pole (or terminal) 212 and pole 214. Terminal 216 selectively makes electrical contact with pole 212 and pole 214 by moving as shown by arrow 218. Terminal 212 is electrically coupled to ground 250. Terminal 214 is electrically coupled with a side of sense resistor 220 that is not coupled to ground 250. Controller moves wiper or terminal 216 via applying a voltage to relay 210 via conductor 270. Controller 12 senses voltages at terminals 214 and 201 via conductors 288 and 289 respectively. Wiper 216 is shown in electrical contact with terminal 214 in a first position. Wiper 216 is in electrical contact with terminal 212 in a second position. Power source 202 provides electrical current to circuit 200.

Controller 12 commands wiper 216 to be in electrical communication with terminal 212 so that oxygen sensor 126 may be heated to a temperature where reliable oxygen sensor measurements may be made. Sense resistor 220 is not in electrical communication with resistive heating element 208 when wiper 216 is in electrical communication with terminal 212. Resistive heating element 208 provides thermal energy to heat an oxygen sensing element (not shown) of oxygen sensor 126 when wiper 216 is in electrical communication with terminal 212. Electrical current flows through only resistive heating element 208 when wiper 216 is in electrical communication with terminal 212. Resistance of resistive heating element 208 may vary between 2 and 20 ohms depending on temperature at a location in the exhaust system where oxygen sensor 126 is placed.

Controller 12 commands wiper 216 to be in electrical communication with terminal 214 so that a resistive offset value of resistive heating element 208 may be determined. Sense resistor 220 is in electrical communication with resistive heating element 208 when wiper 216 is in electrical communication with terminal 214. Electrical current flows through both resistive heating element 208 and sense resistor 220 when wiper 216 is in electrical communication with terminal 214. Sense resistor 220 may have a resistance of about 100 ohms.

Controller 12 senses voltage at 214 during select conditions to determine current flow through resistive heating element 208. The resistance of resistive heating element 208 varies as temperature in the exhaust system about oxygen sensor 126 varies. By determining voltages at terminals 201 and 214, current flow through resistive heating element 208 and sense resistor 220 may be determined as is described in greater detail in the method of FIG. 9. Further, the resistance of resistive heating element 208 may be determined based on current flowing through resistive heating element 208 as is described in greater detail in the method of FIG. 9. The resistance of resistive heating element 208 may then be converted into an exhaust temperature via a transfer function that relates oxygen sensor resistive heating element resistance to temperature.

Figure 3:
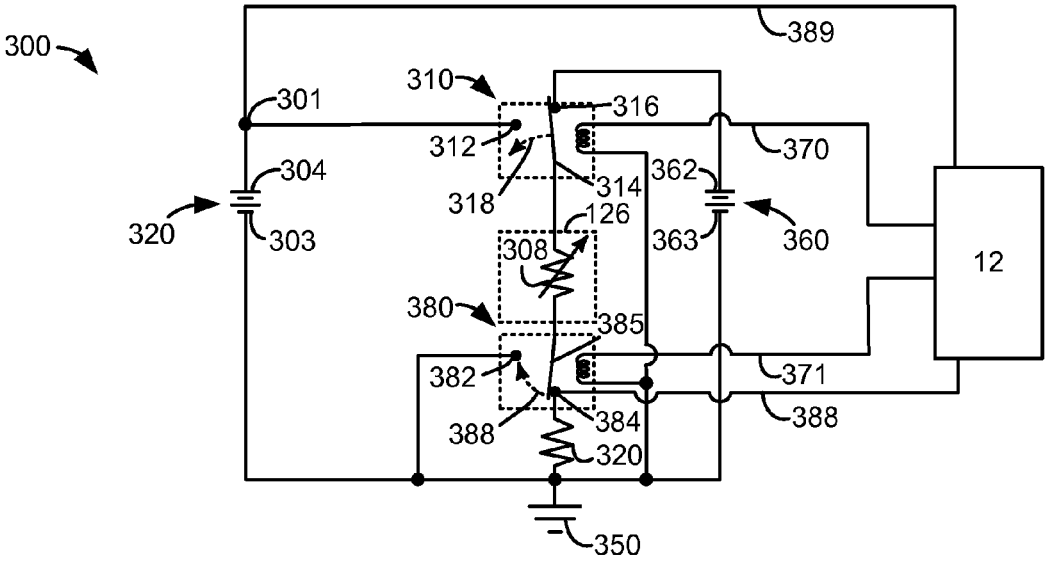

Referring now to FIG. 3, a second example electrical circuit for estimating an oxygen sensor resistive heating element offset resistance is shown. The circuit of FIG. 3 may be included in the system of FIG. 1 along with the method of FIG. 9 to estimate engine exhaust system temperatures.

Circuit 300 includes power source 302 which includes a positive terminal 304 and a negative terminal 303. In one example, power source 302 is a vehicle battery that stores and provides charge to vehicle charge consumers. Negative terminal 303 is shown electrically coupled to ground 350, relay terminal 382, current sense resistor 320, coils of relays 310 and 380, and a negative terminal 363 of second power source 360. Positive terminal 304 is shown electrically coupled terminal 312 of relay 310. Positive terminal 362 of second power supply 360 is shown electrically coupled to terminal 316 of relay 310. Terminal 314 is shown in electrical communication with a first side of resistive heating element 308 of oxygen sensor 126. Terminal 314 operates as a wiper to selectively switch between terminal 312 and terminal 316 as indicated by arrow 318.

A second side of resistive heating element 308 is shown electrically coupled to terminal 385 of relay 380. Terminal 385 operates as a wiper to selectively switch between terminal 382 and terminal 384 as indicated by arrow 388. Terminal 384 is shown electrically coupled to a side of sense resistor 320 opposite of a side coupled to ground 350.

Controller selectively operates relay 310 and relay 380 via applying a voltage to conductors 370 and 371. Controller 12 also senses voltages at terminals 384 and 301 via conductors 388 and 389 respectively. Wiper 314 is shown in electrical contact with terminal 316 in a first position. Wiper 314 is in electrical contact with terminal 312 in a second position. Wiper 385 is shown in electrical contact with terminal 384 in a first position. Wiper 385 is in electrical contact with terminal 382 in a second position. Power source 320 provides electrical current to circuit 300 and resistive heating element 308 when relay 310 is in the second position and when relay 380 is in the second position. Power source 360 provides electrical current to circuit 300 and resistive heating element 308 when relay 310 is in the first position and when relay 380 is in the first position.

Controller 12 commands wiper 314 to be in electrical communication with terminal 312 and wiper 385 to be in electrical communication with terminal 382 so that oxygen sensor 126 may be heated to a temperature where reliable oxygen sensor measurements may be made. Sense resistor 320 is not in electrical communication with resistive heating element 308 when wiper 314 is in electrical communication with terminal 312 and when wiper 385 is in electrical communication with terminal 382. Resistive heating element 308 provides thermal energy to heat an oxygen sensing element (not shown) of oxygen sensor 126 when wiper 314 is in electrical communication with terminal 316 and when wiper 385 is in electrical communication with terminal 384. When wiper 314 is in electrical communication with terminal 312, and when wiper 385 is in electrical communication with terminal 382, electrical current flows through only resistive heating element 308 from power source 320. When wiper 314 is in electrical communication with terminal 316, and when wiper 385 is in electrical communication with terminal 384, electrical current flows through resistive heating element 308 and sense resistor 320 from power source 360. Resistance of oxygen sensor resistive heating element 308 may vary between 2 and 20 ohms depending on temperature at a location in the exhaust system where oxygen sensor 126 is placed.

Controller 12 commands wiper 314 to be in electrical communication with terminal 316 and wiper 385 to be in electrical communication with terminal 384 so that a resistive offset value of resistive heating element 308 may be determined. Sense resistor 320 is in electrical communication with resistive heating element 308 when wiper 314 is in electrical communication with terminal 316 and when wiper 385 is in electrical communication with terminal 384. Sense resistor 220 may have a resistance of about 100 ohms.

Controller 12 senses voltage at 384 during select conditions to determine current flow through resistive heating element 308. The resistance of resistive heating element 308 varies as temperature in the exhaust system about oxygen sensor 126 varies. By determining voltages at terminals 301 and 384, current flow through resistive heating element 308 and sense resistor 320 may be determined as is described in greater detail in the method of FIG. 9. Further, the resistance of resistive heating element 308 may be determined based on current flowing through resistive heating element 308 as is described in greater detail in the method of FIG. 9. The resistance of resistive heating element 308 may then be converted into an exhaust temperature via a transfer function that relates resistive heating element resistance to temperature.

The circuit of FIG. 3 may provide greater immunity to electrical noise as compared to the circuit of FIG. 2. This may be especially true if power supply 360 is electrically isolated and or includes a filtered output.

Figure 4:
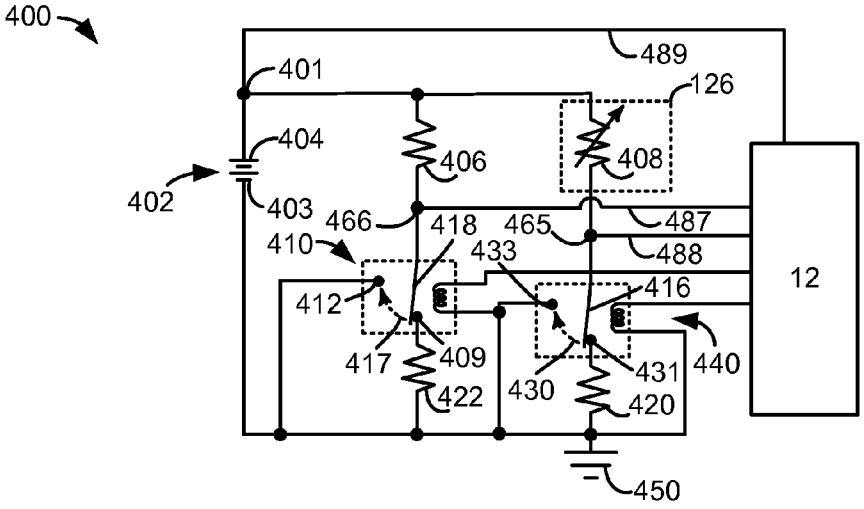

Referring now to FIG. 4, a third example electrical circuit for estimating an oxygen sensor heater element offset resistance is shown. The circuit of FIG. 4 may be included in the system of FIG. 1 along with the method of FIG. 9 to estimate engine exhaust temperatures. The electrical circuit of FIG. 4 may provide electrical noise immunity by use of a differential voltage that reduces common mode noise.

Circuit 400 includes power source 402 which has positive terminal 404 and negative terminal 403. Negative terminal 403 is in electrical communication with ground 450 and low voltage sides of resistor 422 and resistor 420. Positive terminal 404 is shown in electrical communication with oxygen sensor resistive heating element 408 and resistor 406. Resistor 406 is in electrical communication with a high voltage side of resistor 422. Resistive heating element 408 is in electrical communication with terminal or wiper 418 of relay 410.

Terminal 412 is in electrical communication with ground 450. Terminal 409 is in electrical communication with a high voltage side or resistor 422. Wiper 418 is shown in electrical communication with terminal 409 which is the operating state when the offset of oxygen sensor heating element resistor 408 is being determined. Wiper 418 may move as shown by arrow 417 to be in electrical communication with terminal 412 when oxygen sensor heating element resistor 408 is activated to heat oxygen sensor 126 while the offset is not being determined.

Terminal 433 is in electrical communication with ground 450. Terminal 431 is in electrical communication with a high voltage side or resistor 420. Wiper 416 is shown in electrical communication with terminal 431 which is the operating state when the offset of oxygen sensor heating element resistor 408 is being determined. Wiper 416 may move as shown by arrow 430 to be in electrical communication with terminal 433 when oxygen sensor heating element resistor 408 is activated to heat oxygen sensor 126 while the offset is not being determined.

Resistive heating element 408 is included in oxygen sensor 126. Controller 12 measures a differential voltage between terminals 465 and 466 when relays 410 and 440 are positioned as show for oxygen sensor resistive heating element offset determination. By measuring a differential voltage between terminals 465 and 466, common mode electrical noise may be reduced so as to improve an estimate of current that flows through sense resistor 420.

In this circuit, power supply 402 provides voltage and current to resistors 406, 408, 422, and 420 in the illustrated operating state. Power supply 402 supplies a constant voltage so that current flow through resistors 406 and 422 is constant. Current flow between oxygen sensor resistive heating element 408 and sense resistor 420 varies with exhaust temperature at the location of oxygen sensor 126. Changes in current flow through sense resistor 420 may be attributed to exhaust temperature changes. Current flow through sense resistor 420 may be determined similarly to current flow through the sense resistors of FIGS. 2 and 3.

It should be appreciated that solid state transistors or other solid state devices may replace relays shown in FIGS. 2-4. Further, in some examples, the battery negative terminal may provide the ground reference. Further still, the circuits shown in FIGS. 2-4 may be included in controller 12 of FIG. 1.

Thus, the system of FIGS. 1-4 provides for an engine system, comprising: an engine including an oxygen sensor in an exhaust passage; a circuit including a current sense resistor and a resistive heating element of the oxygen sensor; and a controller including non-transitory instructions for estimating an offset resistance for the resistive heating element. The system further comprises additional instructions to estimate an exhaust gas temperature based on the offset. The system further comprises additional instructions to determine the offset after an engine soak time exceeds a threshold. The system further comprises additional instructions to not determine the offset after an engine soak time less than the threshold. The system includes where the offset resistance is estimated relative to an engine operating temperature. The system further comprising additional instructions to adjust an actuator based on the offset.

Figure 5:
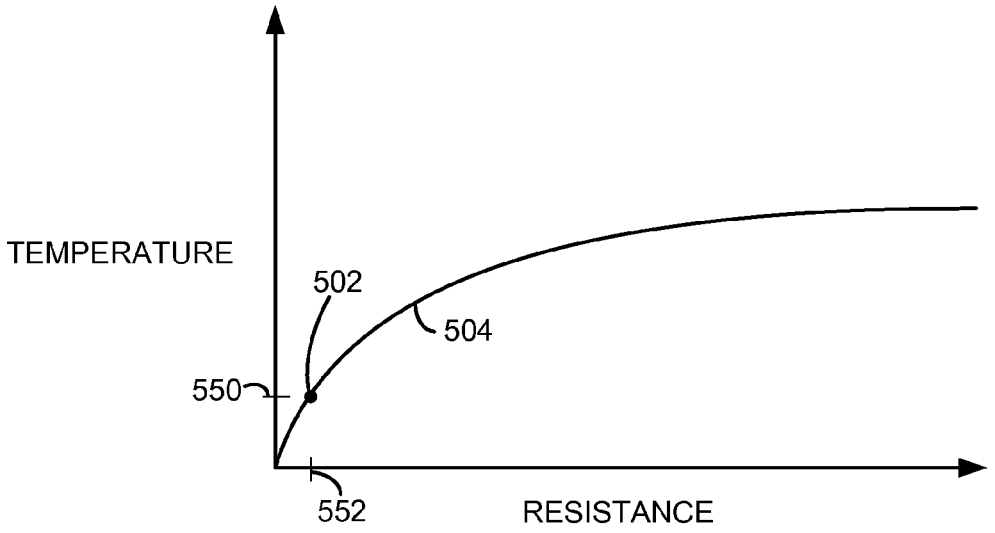
FIGS. 5 and 6 show graphical representations of oxygen sensor resistance offset for temperature estimation.

Referring now to FIG. 5, a plot of oxygen heating element resistance versus temperature is shown. The vertical axis represents temperature and the horizontal axis represents oxygen sensor heating element resistance. Temperature 550 represents a first temperature and resistance 552 represents a first resistance that corresponds to location 502 on curve 504. Curve 504 shows the relationship between heater element resistance and temperature. Thus, it may be observed that heating element resistance increases with increasing temperature. Curve 504 is a curve for a nominal or representative heating element.

Figure 6:
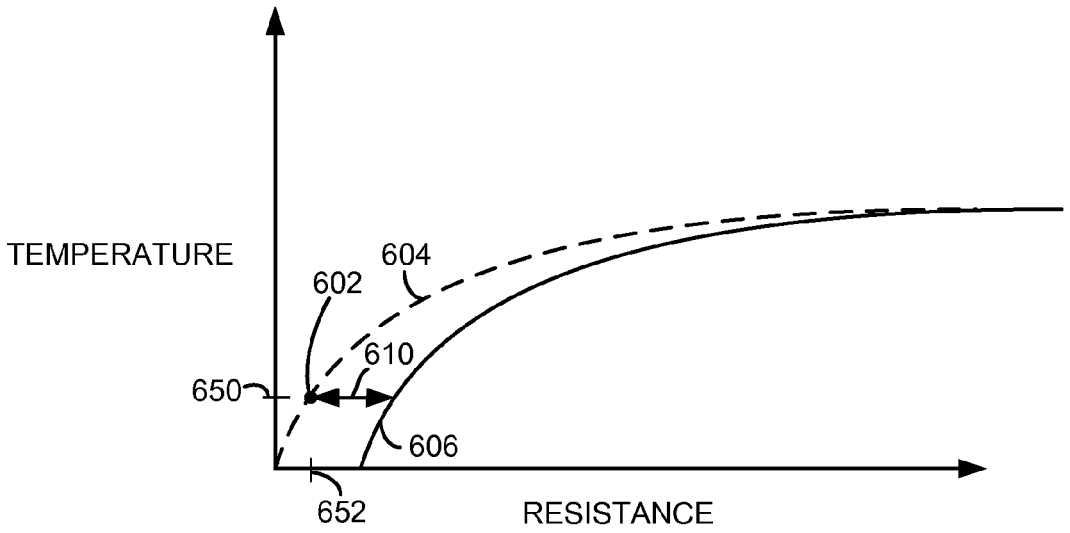

Referring now to FIG. 6, a second plot of oxygen heater resistance versus temperature is shown. The vertical axis represents temperature and the horizontal axis represents heater element resistance. Temperature 650 represents a first temperature and resistance 652 represents a first resistance that corresponds to location 602 on curve 604. Curve 604 shows the relationship between heater element resistance and temperature. Temperature 650 is a same temperature as temperature 550 in FIG. 5. Resistance 652 is a same resistance as resistance 552 in FIG. 5. Curve 604 is a same curve as curve 504 in FIG. 5. Curve 606 represents oxygen heater resistance versus temperature for an oxygen sensor heating element that is not equivalent to a nominal oxygen sensor heating element. The change in curves from curve 604 to curve 606 may be related to manufacturing or environmental variables. Leader 610 shows the resistance offset between curve 604 and curve 606. Method 900 describes how offset 610 may be determined. Exhaust gas temperature is estimated for a sensor having a resistance offset by determining the resistance of the heating element resistor and then indexing the function shown in FIG. 6 which describes curve 606. The function outputs the exhaust temperature value.

Figure 7:
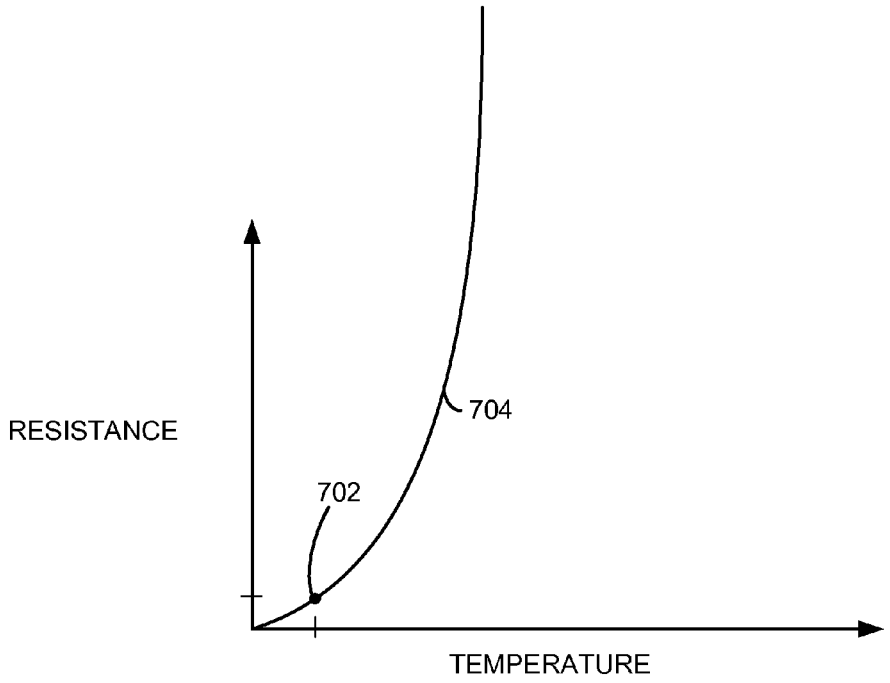
FIGS. 7 and 8 show graphical representations of oxygen sensor resistance offset for oxygen sensor resistance estimation.

Referring now to FIG. 7, a plot of oxygen sensor heating element resistance versus temperature is shown. The plot of FIG. 7 is similar to the plot of FIG. 5 except the axes are reversed so that temperature may be used to determine oxygen sensor heating element resistance for the purpose of determining oxygen sensor heating element resistance offset. The vertical axis represents oxygen sensor heating element resistance and the horizontal axis represents temperature. Curve 704 is the same as curve 504 shown in FIG. 5. The plot illustrates a form of a transfer function for converting from temperature to oxygen sensor heating element resistance. The plot or transfer function may be indexed based on exhaust temperature, and the transfer function outputs oxygen sensor heating element resistance. The curve location at 702 is the same location as 502 in FIG. 5.

Figure 8:
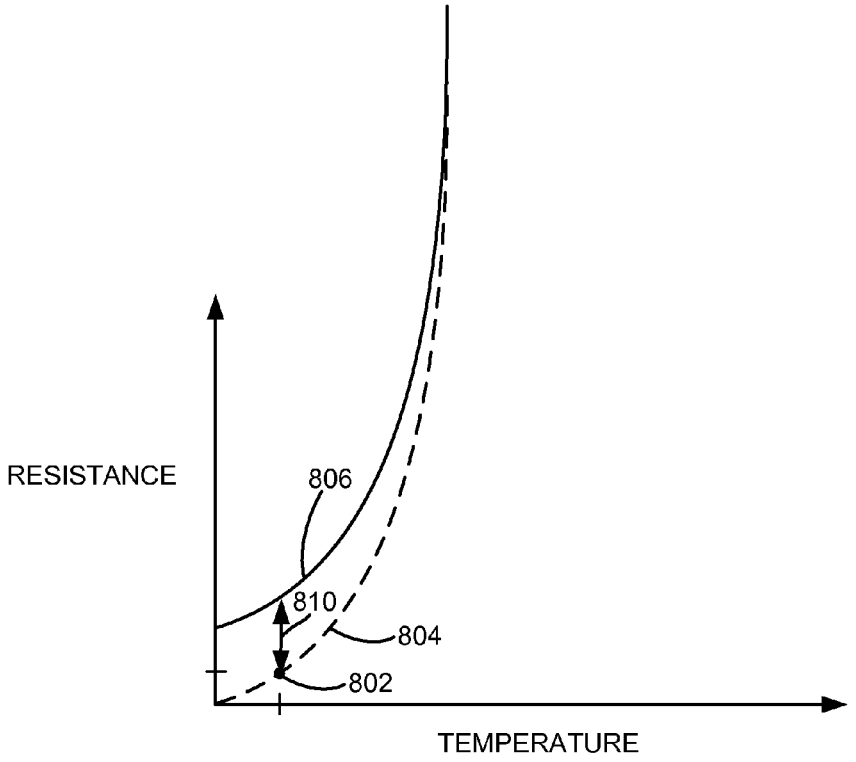
Figure 9:
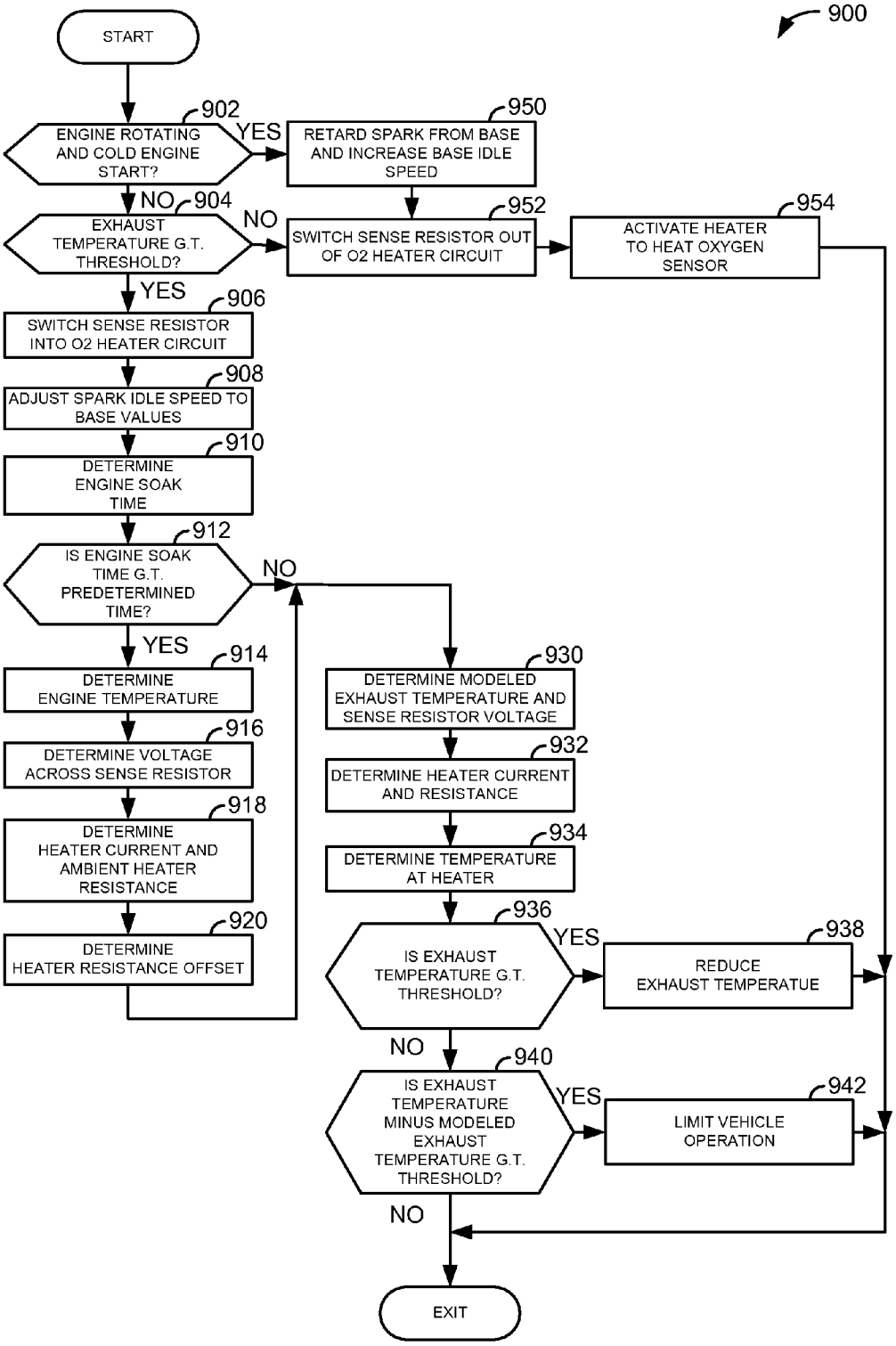
FIG. 9 shows an example method for determining and applying exhaust temperature is shown.

Referring now to FIG. 8, a plot of oxygen sensor heating element resistance including offset resistance versus temperature is shown. The plot of FIG. 8 is similar to the plot of FIG. 6 except the axes are reversed so that temperature may be used to determine oxygen sensor heating element resistance for the purpose of determining oxygen sensor heating element resistance offset. The vertical axis represents oxygen sensor heating element resistance and the horizontal axis represents temperature. Curve 804 is the same as curve 604 shown in FIG. 6. Curve 806 is the same as curve 606 shown in FIG. 6. The plot illustrates a form of a transfer function for converting from temperature to oxygen sensor heating element resistance including an offset resistance. The plot or transfer function may be indexed based on exhaust temperature, and the transfer function outputs oxygen sensor heating element resistance. The curve location at 802 is the same location as 602 in FIG. 6.

Referring now to FIG. 9, a method for determining and applying exhaust temperature is shown. The method of FIG. 9 may be included in the system of FIGS. 1-4. At least portions of the method of FIG. 9 may be incorporated to controller 12 in the system of FIG. 1 as executable instructions stored in non-transitory memory. Further, portions of the method of FIG. 9 may be actions taken by controller 12 in the physical world to transform vehicle operating conditions. Additionally, controller inputs as shown in FIG. 1 may be received via a controller at the start of Method 900.

At 902, method 900 judges if the engine is rotating and the engine is being cold started. Method 900 may judge that the engine is rotating via determining a change in engine position. Method 900 may judge that the engine is being cold started based on engine temperature and time since engine stop. If method 900 judges that the engine is rotating and being cold started, the answer is yes and method 900 proceeds to 950. Otherwise, the answer is no and method 900 proceeds to 904.

At 950, method 900 retards spark timing and increases engine idle speed to increase heat flux provided to the vehicle's catalyst. Increasing engine heat flux may reduce engine emissions by activating the catalyst sooner after engine start. Method 900 proceeds to 952 after spark timing is retarded and engine idle speed is increased from a base engine idle speed.

At 952, method 900 switches the oxygen sensor current sense resistor out of the oxygen sensor heater circuit. For example, with regard to FIG. 2, relay terminal 216 may be in electrical communication with relay terminal 212 so that current from power supply 202 does not flow through current sense resistor 220. Sense resistor 320 of FIG. 3 may be switched out of circuit 300 so that current from power supply 320 flows through oxygen sensor heating element 308, but not through sense resistor 320. By switching the sense resistor out of the oxygen sensor heating circuit, current flow through the oxygen sensor heating element may be increased to increase oxygen sensor heating. Method 900 proceeds to 954 after the sense resistor is switched out of the oxygen sensor heater circuit.

At 954, method 900 activates the heating element of the oxygen sensor. The heating element is activated by applying a voltage to the heating element. By activating the heating element, oxygen sensor accuracy may be improved. Method 900 proceeds to exit after activating the oxygen sensor heating element.

At 904, method 900 judges if exhaust temperature is greater than a threshold temperature. If exhaust temperature is greater than a threshold temperature, the oxygen sensor oxygen reading may be accurate without activating the oxygen sensor heating element. The exhaust temperature may be estimated or measured. In one example, exhaust temperature may be estimated by indexing a table or function that outputs empirically determined exhaust temperature values based on engine speed and engine load. If exhaust temperature is greater than a threshold temperature, the answer is yes and method 900 proceeds to 906. Otherwise, the answer is no and method 900 proceeds to 952.

At 906, switches the oxygen sensor current sense resistor in to the oxygen sensor heater circuit. For example, with regard to FIG. 2, relay terminal 216 may be in electrical communication with relay terminal 214 so that current from power supply 202 flows through current sense resistor 220 and heating element 208. Sense resistor 320 of FIG. 3 may be switched in circuit 300 so that current from power supply 360 flows through oxygen sensor heating element 308 and sense resistor 320. By switching the sense resistor into the oxygen sensor heating circuit, current flow through the oxygen sensor heating element may be determined. Method 900 proceeds to 908 after the sense resistor is switched into the oxygen sensor heater circuit.

At 908, method 900 adjusts spark timing and engine idle speed to base values. Spark timing and engine idle speed are adjusted to base values to increase vehicle fuel economy when the catalyst is warm. Method 900 proceeds to 910 after spark timing and idle speed are adjusted.

At 910, method 900 determines engine soak time. In one example, a timer stores a time the engine is stopped and compares it to a time the engine is restarted to determine soak time. In other words, soak time is an amount of time the engine is stopped from rotating and not operating. Method 900 proceeds to 912 after soak time is determined.

At 912, method 900 judges if the engine soak time is greater than (G.T.) a predetermined threshold amount of time (e.g., 6 hours). If so, the answer is yes and method 900 proceeds to 914. Otherwise, the answer is no and method 900 proceeds to 930.

At 914, method 900 determines engine temperature. Engine temperature may be determined via a cylinder head temperature sensor, engine coolant temperature sensor, or intake air temperature sensor. Method 900 proceeds to 916 after engine temperature is determined.

At 916, method 900 determines a voltage drop across a sense resistor in the oxygen sensor heating element circuit. For example, method 900 determines a voltage at terminal 214 of FIG. 2, voltage at terminal 384 of FIG. 3, or voltage between terminals 465 and 466 of FIG. 4. Method 900 proceeds to 918 after the voltage drop across the current sense resistor is determined.

At 918, method 900 determines oxygen sensor heating element current $I_H$. In one example, $I_H$ is determined via the following equation:

$$I_H = \frac{V_S}{R_S}$$

where $I_H$ is current passing through the oxygen sensor resistive heating element, $V_S$ is voltage drop across the oxygen sensor resistive heating element, and $R_S$ is resistance of the sense resistor. Resistance of the oxygen sensor resistive heating element $R_{HAMB}$ at ambient conditions is determined via the following equation:

$$R_{HAMB} = \frac{V_{source} - (I_H \cdot R_s)}{I_H}$$

where $R_{HAMB}$ is oxygen sensor resistive heating element resistance at ambient conditions, $V_{source}$ is voltage output of the power supply coupled to the oxygen sensor resistive heating element (e.g., 202 of FIG. 2, 360 of FIG. 3, or 402 of FIG. 4), and the remaining variables are as previously described. Method 900 proceeds to 920 after oxygen sensor resistive heating element resistance at ambient conditions is determined.

At 920, method 900 determines the oxygen sensor resistive heating element's resistance offset. Curve 606 of FIG. 6 may be described as $T_H$=FN_$T_{cal}$($R_H$+$R_{OFF}$), where $T_H$ is exhaust temperature as determined from oxygen sensor resistive heating element resistance, where $R_{OFF}$ is the oxygen sensor resistive heating element resistance offset, and where FN_Tcal is the function describing the relationship between the oxygen sensor heating element resistance and exhaust temperature for the ideal or nominal oxygen sensor resistive heating element (e.g., FIG. 5). Therefore, the oxygen sensor resistive heating element resistance offset is given by the equation:

$$R_{OFF}=R_{HAMB}-FNR_{cal}(T_{amb})$$

where $T_{amb}$ is ambient temperature and FNRcal is the inverse function of FN_Tcal. Method 900 proceeds to 930 after the resistance offset value is determined.

At 930, method 900 determines modeled exhaust temperature and sense resistor voltage. In one example, modeled exhaust temperature may be estimated by indexing a table or function that outputs empirically determined exhaust temperature values based on engine speed and engine load. The current sense resistor voltage drop is determined by the controller receiving a voltage at 214 of FIG. 2, a voltage at 385 of FIG. 3, or a voltage between 465 and 466 of FIG. 4. Method 900 proceeds to 932 after sense resistor voltage and modeled exhaust temperature are determined.

At 932, method 900 determines oxygen sensor heater current and resistive heating element resistance. Oxygen sensor resistive heating element current is determined from the equation:

$$I_H = \frac{V_S}{R_S}$$

Oxygen sensor resistive heating element resistance is determined from the equation:

$$R_H = \frac{V_{source} - (I_H \cdot R_s)}{I_H}$$

where $R_H$ is the oxygen sensor resistive heating element resistance and the remaining variables are as previously described. Method 900 proceeds to 934 after the oxygen sensor resistive heating element resistance is determined.

At 934, method 900 determines temperature of engine exhaust at a location in the exhaust system where the oxygen sensor is located. The temperature is determined by the equation $T_H$=FN_$T_{cal}$($R_H$+$R_{OFF}$). Method 900 proceeds to 936 after exhaust temperature is determined.

At 936, method 900 judges if exhaust temperature is greater than (G.T.) a threshold temperature. In one example, the threshold temperature represents a temperature above which the possibility of exhaust system component degradation may increase. If method 900 judges that exhaust temperature is greater than the threshold temperature, the answer is yes and method 900 proceeds to 938. Otherwise, the answer is no and method 900 proceeds to 940.

At 938, method 900 invokes measures to reduce exhaust temperature. In one example, method 900 richens the engine air-fuel ratio by increasing an amount of fuel injected to the engine via increasing an amount of fuel injected to the engine via injectors. Further, method 900 may prevent deceleration fuel shut-off where fuel injection ceases during low load conditions while the engine continues to rotate. Method 900 proceeds to exit after exhaust temperature reduction actions are applied.

At 940, method 900 judges if exhaust temperature measured via the oxygen sensor resistive heating element minus modeled exhaust temperature is greater than (G.T.) a threshold temperature. The temperature difference may provide an indication of oxygen sensor heating element degradation. If method 900 judges that exhaust temperature based on the oxygen sensor resistive heating element minus modeled exhaust temperature is greater than (G.T.) a threshold temperature, the answer is yes and method 900 proceeds to 942. Otherwise, the answer is no and method 900 proceeds to exit.

It should be noted that if method 900 exits from 940, engine parameters and actuators may be adjusted based on exhaust temperature as determined from the oxygen sensor resistive heating element resistance. For example, engine idle speed and air mass flow may be increased via adjusting a throttle if exhaust gas temperatures indicate reduced catalyst temperature.

At 942, method 900 limits vehicle operation. In one example, a peak exhaust temperature may be limited via limiting engine torque via reducing a maximum throttle opening amount or valve timing. For example, maximum engine torque may be reduced from 400 N-m to 350 N-m via reducing a maximum throttle opening amount. Additionally, method 900 may provide a driver with an indication of degradation via a diagnostic code. Method 900 proceeds to exit after vehicle operation is limited.

In this way, method 900 determines an offset resistance correction for a heating element of an oxygen sensor. The offset resistance value along with the oxygen sensor resistive heating element resistance is then used to estimate exhaust temperatures.

Thus, the method of FIG. 9 provides for a method for an engine, comprising: receiving input from a sensor to a controller; estimating an offset for a resistance value of an exhaust gas sensor heater element relative to an engine operating temperature from the input via the controller; estimating an engine exhaust gas temperature based on the resistance value of the exhaust gas sensor and the offset via the controller; and adjusting an actuator in response to the engine exhaust gas temperature. The method includes where the offset is based on current flow through the exhaust gas sensor heater element. The method includes where the actuator is a fuel injector. The method includes where the actuator is a throttle.

In some examples, the method includes where the exhaust gas sensor heater element is included in an exhaust gas oxygen sensor. The method also includes where the offset is based on ambient operating conditions. The method includes where the ambient operating conditions include engine temperature.

The method of FIG. 9 also provides for a method for an engine, comprising: after a soak time greater than a threshold, receiving input from a sensor to a controller, estimating an offset resistance value of an exhaust gas sensor relative to an engine operating temperature from the input via the controller before an engine start; and after a soak time less than the threshold, not estimating the offset and adjusting actuators in response to a temperature determined via an oxygen sensor. The method includes where the soak time is a time when an engine is stopped and not rotating. The method includes where the actuators are adjusted via the controller.

In some examples, the method includes where the offset resistance is determined based on current flow through an oxygen sensor resistive heating element. The method further comprises estimating an exhaust temperature based on the offset resistance value. The method further comprises adjusting an actuator in response to the exhaust temperature. The method includes where the actuator is adjusted to reduce the exhaust temperature.

As will be appreciated by one of ordinary skill in the art, the methods described in FIG. 9 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the methods described herein may be a combination of actions taken by a controller in the physical world and instructions within the controller. At least portions of the control methods and routines disclosed herein may be stored as executable instructions in non-transitory memory and may be carried out by the control system including the controller in combination with the various sensors, actuators, and other engine hardware. In addition, the terms aspirator or venturi may be substituted for ejector since the devices may perform in a similar manner.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A method for an engine, comprising: receiving input from a sensor to a controller;

estimating an offset for a resistance value of an oxygen sensor heater element based on an engine operating temperature and an ambient temperature from the input via the controller;

estimating an engine exhaust gas temperature based on the resistance value of the oxygen sensor heater element and the offset via the controller; and adjusting an actuator in response to the engine exhaust gas temperature.

2. The method of claim 1, where the offset is based on current flow through the exhaust gas sensor heater element.

3. The method of claim 1, where the actuator is a fuel injector.

4. The method of claim 1, where the actuator is a throttle.

5. The method of claim 1, where the exhaust gas sensor heater element is included in an exhaust gas oxygen sensor.

6. A method for an engine, comprising:

after a soak time greater than a threshold, receiving input from a sensor to a controller, estimating an offset resistance value of an exhaust gas sensor based on an engine operating temperature and an ambient temperature from the input via the controller before an engine start; and after a soak time less than the threshold, not estimating the offset and adjusting actuators in response to a temperature determined via an oxygen sensor.

7. The method of claim 6, where the soak time is a time when the engine is stopped and not rotating.

8. The method of claim 6, where the actuators are adjusted via the controller.

9. The method of claim 6, where the offset resistance value is determined based on current flow through an oxygen sensor resistive heating element.

10. The method of claim 6, further comprising estimating an exhaust temperature based on the offset resistance value.

11. The method of claim 10, further comprising adjusting an actuator in response to the exhaust temperature.

12. The method of claim 11, where the actuator is adjusted to reduce the exhaust temperature.

13. An engine system, comprising:

an engine including an oxygen sensor in an exhaust passage;

a circuit including a current sense resistor and a resistive heating element of the oxygen sensor; and a controller including non-transitory instructions for estimating an offset resistance for the resistive heating element.

14. The system of claim 13, further comprising additional instructions to estimate an exhaust gas temperature based on the offset resistance.

15. The system of claim 14, further comprising additional instructions to determine the offset resistance after an engine soak time exceeds a threshold.

16. The system of claim 15, further comprising additional instructions to not determine the offset resistance after an engine soak time less than the threshold.

17. The system of claim 16, where the offset resistance is estimated relative to an engine operating temperature.

18. The system of claim 17, further comprising additional instructions to adjust an actuator based on the offset resistance.

* * * * *